US007140606B2

(12) United States Patent
Suga et al.

(10) Patent No.: US 7,140,606 B2
(45) Date of Patent: Nov. 28, 2006

(54) SHEET FEEDING APPARATUS AND IMAGE FORMING APPARATUS HAVING THE SAME

(75) Inventors: Takeshi Suga, Ibaraki (JP); Seiichiro Adachi, Chiba (JP); Hiroto Koga, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/357,023

(22) Filed: Feb. 21, 2006

(65) Prior Publication Data

US 2006/0180984 A1 Aug. 17, 2006

Related U.S. Application Data

(62) Division of application No. 10/916,438, filed on Aug. 12, 2004, now abandoned.

(30) Foreign Application Priority Data

Aug. 26, 2003 (JP) ..... 2003-301029

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS

| | | | | |
|---|---|---|---|---|
| 5,546,168 | A | 8/1996 | Adachi et al. | 355/233 |
| 5,678,127 | A | 10/1997 | Suga | 399/45 |
| 5,700,002 | A | 12/1997 | Kato et al. | 270/58.12 |
| 6,015,144 | A | 1/2000 | Yoshii et al. | 271/97 |
| 6,059,285 | A | 5/2000 | Suga et al. | 271/228 |
| 6,260,840 | B1 | 7/2001 | Suga et al. | 271/10.12 |
| 6,276,677 | B1 | 8/2001 | Hommochi et al. | 270/32 |
| 6,298,214 | B1 | 10/2001 | Koga | 399/322 |
| 2003/0170059 | A1 | 9/2003 | Koga et al. | 399/381 |
| 2004/0081496 | A1 | 4/2004 | Endo et al. | 399/390 |
| 2004/0089994 | A1* | 5/2004 | Koga et al. | 271/98 |
| 2005/0040584 | A1* | 2/2005 | Isemura | 271/97 |

FOREIGN PATENT DOCUMENTS

| | | | |
|---|---|---|---|
| JP | 4-94337 | * | 3/1992 |
| JP | 4-161396 | * | 6/1992 |
| JP | 4-365739 | * | 12/1992 |
| JP | 11-5643 | | 1/1999 |
| JP | 2001-48366 | | 2/2001 |

* cited by examiner

*Primary Examiner*—Patrick Mackey
*Assistant Examiner*—Thomas Morrison
(74) *Attorney, Agent, or Firm*—Fitzpatrick, Cella, Harper & Scinto

(57) ABSTRACT

A sheet feeding apparatus for feeding sheets supported by sheet stacking means capable of ascending and descending by sheet feeding means is provided. The sheet feeding apparatus includes sheet position detection means for detecting that an upper surface of a sheet stack supported by said sheet stacking means reaches a position whereat it can be fed by said sheet feeding means, blowing means for blowing air on an end portion of sheets stacked on said sheet stacking means, and control means for controlling said blowing means, wherein at least, either when it has been detected by said sheet position detection means that the sheets reach a position whereat they can be fed, or before a sheet feeding operation by said sheet feeding means is started, said control means performs a blowing operation by said blowing means during predetermined time.

11 Claims, 15 Drawing Sheets

RELATIONSHIP BETWEEN ATTRACTION FORCE AND RELATIVE HUMIDITY (TEMPERATURE IS 30°C)

TEMPORAL CHANGE OF ATTRACTION FORCE
(ENVIRONMENT: 30℃ - 80%)

FIG. 10

CONTROL TABLE OF INITIAL SWING TIME (T1)

| | | | | | | | | | |
|---|---|---|---|---|---|---|---|---|---|
| EQUAL TO OR MORE THAN 80% | 30 SEC | 30 SEC | 30 SEC | 30 SEC | 30 SEC | 30 SEC | 50 SEC | 50 SEC | 50 SEC |
| 70% | 30 SEC | 30 SEC | 30 SEC | 30 SEC | 30 SEC | 30 SEC | 30 SEC | 30 SEC | 30 SEC |
| 60% | 20 SEC | 20 SEC | 20 SEC | 20 SEC | 20 SEC | 30 SEC | 30 SEC | 30 SEC | 30 SEC |
| 50% | 10 SEC | 10 SEC | 15 SEC | 15 SEC | 15 SEC | 20 SEC | 20 SEC | 20 SEC | 20 SEC |
| 45% | 5 SEC | 5 SEC | 10 SEC | 10 SEC | 10 SEC | 15 SEC | 15 SEC | 15 SEC | 15 SEC |
| 40% | 0 SEC | 5 SEC | 5 SEC | 5 SEC | 5 SEC | 5 SEC | 5 SEC | 10 SEC | 10 SEC |
| EQUAL TO OR LESS THAN 30% | 0 SEC | 0 SEC | 0 SEC | 5 SEC | 5 SEC | 5 SEC | 5 SEC | 5 SEC | 5 SEC |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR MORE THAN 60℃ |

FIG. 11

CONTROL TABLE OF PRE-JOB SWING TIME (T2)

| EQUAL TO OR MORE THAN 80% | 10 SEC | 10 SEC | 10 SEC | 10 SEC | 10 SEC | 10 SEC | 10 SEC | 10 SEC | 10 SEC |
|---|---|---|---|---|---|---|---|---|---|
| 70% | 8 SEC | 8 SEC | 8 SEC | 8 SEC | 8 SEC | 10 SEC | 10 SEC | 10 SEC | 10 SEC |
| 60% | 5 SEC | 5 SEC | 5 SEC | 5 SEC | 5 SEC | 8 SEC | 8 SEC | 8 SEC | 8 SEC |
| 50% | 5 SEC | 5 SEC | 5 SEC | 5 SEC | 5 SEC | 5 SEC | 5 SEC | 5 SEC | 5 SEC |
| 45% | 3 SEC | 3 SEC | 3 SEC | 3 SEC | 5 SEC | 5 SEC | 5 SEC | 5 SEC | 5 SEC |
| 40% | 2 SEC | 2 SEC | 2 SEC | 2 SEC | 2 SEC | 2 SEC | 4 SEC | 4 SEC | 4 SEC |
| EQUAL TO OR LESS THAN 30% | 0 SEC | 0 SEC | 0 SEC | 0 SEC | 0 SEC | 0 SEC | 0 SEC | 0 SEC | 0 SEC |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR MORE THAN 60℃ |

FIG. 12

CONTROL TABLE OF TEMPERATURE CONTROL OF HEATER 6 FOR COATED SHEET

| | | | | | | | | | |
|---|---|---|---|---|---|---|---|---|---|
| EQUAL TO OR MORE THAN 80% | 85℃ | 85℃ | 85℃ | 85℃ | 85℃ | 85℃ | 85℃ | 85℃ | OFF |
| 70% | 80℃ | 80℃ | 80℃ | 80℃ | 85℃ | 85℃ | 85℃ | 85℃ | OFF |
| 60% | 70℃ | 70℃ | 70℃ | 70℃ | 80℃ | 80℃ | 80℃ | 80℃ | OFF |
| 50% | 65℃ | 65℃ | 65℃ | 65℃ | 65℃ | 70℃ | 70℃ | 70℃ | OFF |
| 45% | 60℃ | 60℃ | 60℃ | 60℃ | 60℃ | 65℃ | 65℃ | 65℃ | OFF |
| 40% | OFF | OFF | OFF | OFF | OFF | OFF | OFF | OFF | OFF |
| EQUAL TO OR LESS THAN 30% | OFF | OFF | OFF | OFF | OFF | OFF | OFF | OFF | OFF |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR MORE THAN 60℃ |

SHEET FEEDING APPARATUS AND IMAGE FORMING APPARATUS HAVING THE SAME

This application is a divisional of U.S. patent application No. Ser. 10/916,438, filed Aug. 12, 2004, now abandoned.

BACKGROUND OF THE INVENTION

1. Field of the Invention

The present invention relates to a sheet feeding apparatus and an image forming apparatus having the same, and more particularly to structure for separating and feeding sheets having high adhesion properties between those sheets.

2. Related Background Art

A conventional image forming apparatus such as a copying machine and a printer has had a sheet feeding apparatus which after feeding out sheets stacked on sheet stacking means one sheet at a time from one at the uppermost position in order by a pickup roller which is sheet feeding means, separates one sheet at a time by a separating portion for feeding to an image forming portion.

In this case, when continuous sheets feeding is performed in such a sheet feeding apparatus, cut sheets are used, and such cut sheets have been normally limited to woodfree paper or standard sheets designated by the copying machine manufacturer. Also, in order to reliably separate such sheets one sheet at a time for feeding, various separating methods have been conventionally adopted, and as such a separating system, there is, for example, a separating pad system in which a frictional member is caused to abut against a feed roller at predetermined pressure for preventing double feeding.

Also, as another separating system, there is a retard separating system in which a feed roller for rotating in a sheet conveying direction and a separating roller which is driven in a direction opposite to the sheet conveying direction at predetermined torque and abuts against the feed roller at predetermined pressure constitute a separating portion, and by this separating portion, only the sheet at the uppermost level of a sheet stack sent out by the pickup roller is caused to pass through, and another sheet which has been accompanied by the uppermost sheet and fed is returned on the sheet stacking means side to thereby prevent double feeding.

In this case, in order to reliably separate and feed sheets by these separating systems, in the case of, for example, the retard separating system, it has become possible to reliably separate sheets one sheet at a time by optimizing the return torque of the separating roller and the applied pressure by taking into consideration the frictional force of the sheet to be fed.

In recent years, along with the diversification of sheets (recording media), there has been growing a request for forming an image also on a sheet such as a coated sheet obtained by performing coating processing on the surface of a sheet in order to give brightness or a gloss from the request from the market for colorization in addition to ultra-thick paper, an OHP sheet, art film and the like.

When the ultra-thick paper is going to be fed, however, the dead load of the ultra-thick paper becomes conveying resistance and the paper cannot be picked up, but paper jam occurs. Also, sheets made of resin material easy to be charged with electricity as in the case of the OHP sheet or the art film are incapable of picking up or cause double feeding because during a feeding operation under a low humidity environment, sheets rub against each other, whereby their sheet surfaces are gradually charged with electricity and the sheets come to stick to each other by Coulomb forces.

Also, in coated sheets obtained by coating the surface of a sheet with coating material consisting of paint or the like, since the coated sheets have a property that the sheets attract each other particularly when stacking under a high humidity environment, there arises a problem that pickup cannot be performed and double feeding occurs frequently.

This is because although in the case of such a specialty sheet as described above, a frictional force itself between the sheets themselves is equal to or less than that of standard sheet and the like, in the case of resin material sheets, by means of an attraction force due to frictional charging under the low humidity environment, and in the case of the coated sheet, by means of an attraction force under the high humidity environment, the attraction is performed by a far higher force than the frictional force between the sheets themselves, and therefore, separation can be hardly made by the conventional separating system.

In other words, in the conventional separating system, since only the frictional force between the sheets themselves has been taken into consideration, the sheets cannot be reliably separated when such an attraction force other than the frictional force is exerted.

Thus, in order to nullify such a very high attraction force between the sheets themselves, there is a separation feeding system in which as disclosed in Japanese Patent Application Laid-Open No. H11-005643, air is blown from the side of the sheet stack to ravel the sheets in advance; in a state in which any attraction between the sheets has been nullified, the sheets are picked up one sheet at a time from a sheet at a higher position; and the sheets are separated one sheet at a time at a separating portion provided at the downstream portion. Apparatuses in which this separation feeding system has been adopted have been used in the printing business world or in some copying machines.

In the separation feeding system having means (hereinafter, referred to as auxiliary air raveling means) for blowing air from the side of such a sheet stack, since even sheets (recording media) having such a high attraction force as described above nullify the attraction by raveling the sheets prior to feeding, the separation performance has been improved as compared with the system utilizing only the frictional force described above.

FIG. 15 is a view showing structure of a sheet feeding apparatus having such auxiliary air raveling means, and this sheet feeding apparatus 155 has: a sheets feeding tray 59 for stacking sheets S; sheet feeding means (not shown) for sending out a sheet S from the sheets feeding tray 59; air blowing means 71 for blowing air on the side of the sheets S stacked; and flow path moving means 157 for moving the air blowing means 71 in the vertical direction along the side of the sheet S in a vertical direction.

The flow path moving means 157 has: a guide rail (not shown) for supporting the air blowing means 71 in a perpendicular direction in such a manner as to be freely movable; an electrical motor 121; and a cam plate 123 fixed to the output shaft of this electrical motor 121, for moving the air blowing means 71 by slidably contacting the underside of the air blowing means 71.

In such a flow path moving means 157, when the electrical motor 121 rotates, the cam plate 123 causes the air blowing means 71 to move in the vertical direction, and accordingly, an air course is to move in the vertical direction. In this case, since an opening (air duct port) of the air blowing means 71 has an opening area which is constant always, when the air blowing means 71 lowers, the side of the sheet S is to face the opening, whereby the area of the opening is reduced, and air to be blown off from the opening is to be narrowed down. As a result, it becomes possible to nullify the attraction between all the sheets by causing the sheet S at a higher position to float in the air.

In this respect, as the separation feeding system in which air has been arranged to be flown from the side of the sheet stack as described above, there is a sheet feeding apparatus in which as disclosed in Japanese Patent Laid-Open No. 2001-48366, the blown air is heated by a heater to thereby dehumidify the sheets and the attraction force of the sheets (coated sheets) particularly under a high humidity environment has been mitigated.

In the sheet feeding apparatus in which the separation feeding system for blowing air from the side of the sheet stack has been adopted, however, when air is blown, only the neighborhood of the air blowoff port of the sheets stacked is partially dried particularly under a low humidity environment.

Thus, when the sheets are partially dried as described above, unevenness develops in the surface resistance value within the sheet surface, and as a result, when the sheet is fed to an image forming portion of the image forming apparatus, this dried portion causes a transfer failure, resulting in an image defect. Particularly, in the case of an electrophotography system in which the image forming portion transfers a toner image on the sheet through the use of static electricity, since the transfer performance greatly depends upon the surface resistance value of the sheet surface, when unevenness develops in the surface resistance value, transfer unevenness occurs, image deterioration due to it is conspicuous, and becomes very unsightly.

SUMMARY OF THE INVENTION

The present invention has been achieved in view of the above-mentioned state of affairs, and is aimed to provide a sheet feeding apparatus capable of reliably separating and feeding sheets without causing image defects such as transfer failures, and an image forming apparatus having the same.

According to one aspect of the present invention, a sheet feeding apparatus for feeding sheets supported by liftable sheet stacking means, comprising:

sheet feeding means for feeding a sheet supported on said sheet stacking means;

sheet position detection means for detecting that an upper surface of a sheet stack supported by said sheet stacking means reaches a feeding position whereat it can be fed by said sheet feeding means;

blowing means for blowing air on an end portion of sheets stacked on said sheet stacking means; and control means for controlling said blowing means, wherein at least, either when it has been detected by said sheet position detection means that the upper surface of the sheet stack reach the feeding position, or before a sheet feeding operation by said sheet feeding means is started, said control means performs a blowing operation by said blowing means during a predetermined time.

According to another aspect of the invention, a sheet feeding apparatus for feeding sheets, comprising:

a lifter base on which a sheet stack has been stacked; a pickup roller for sending out sheets from said lifter base;

an air duct port arranged to oppose to an end portion of the sheet stack on said lifter base;

a fan for blowing air through said air duct port;

a sheet surface position detection sensor for detecting, by raising said lifter base, that an upper surface of the sheet stack reaches a feeding position whereat it can be fed; and a controller for controlling an operation of said fan, wherein at least either when it has been detected by said sheet surface position detection sensor that the sheet stack reaches the feeding position whereat, or before a sheet feeding operation by said pickup roller is started, said fan is caused to perform a blowing operation.

BRIEF DESCRIPTION OF THE DRAWINGS

FIG. 10 is a control table for controlling initial swing time of the above-described sheet feeding apparatus;

FIG. 11 is a control table for controlling pre-job swing time of the above-described sheet feeding apparatus;

FIG. 12 is a control table for controlling temperature for heater temperature control of the above-described sheet feeding apparatus;

DESCRIPTION OF THE PREFERRED EMBODIMENTS

Hereinafter, with reference to the drawings, the detailed description will be made of the best example for carrying out the present invention.

Figure 1:
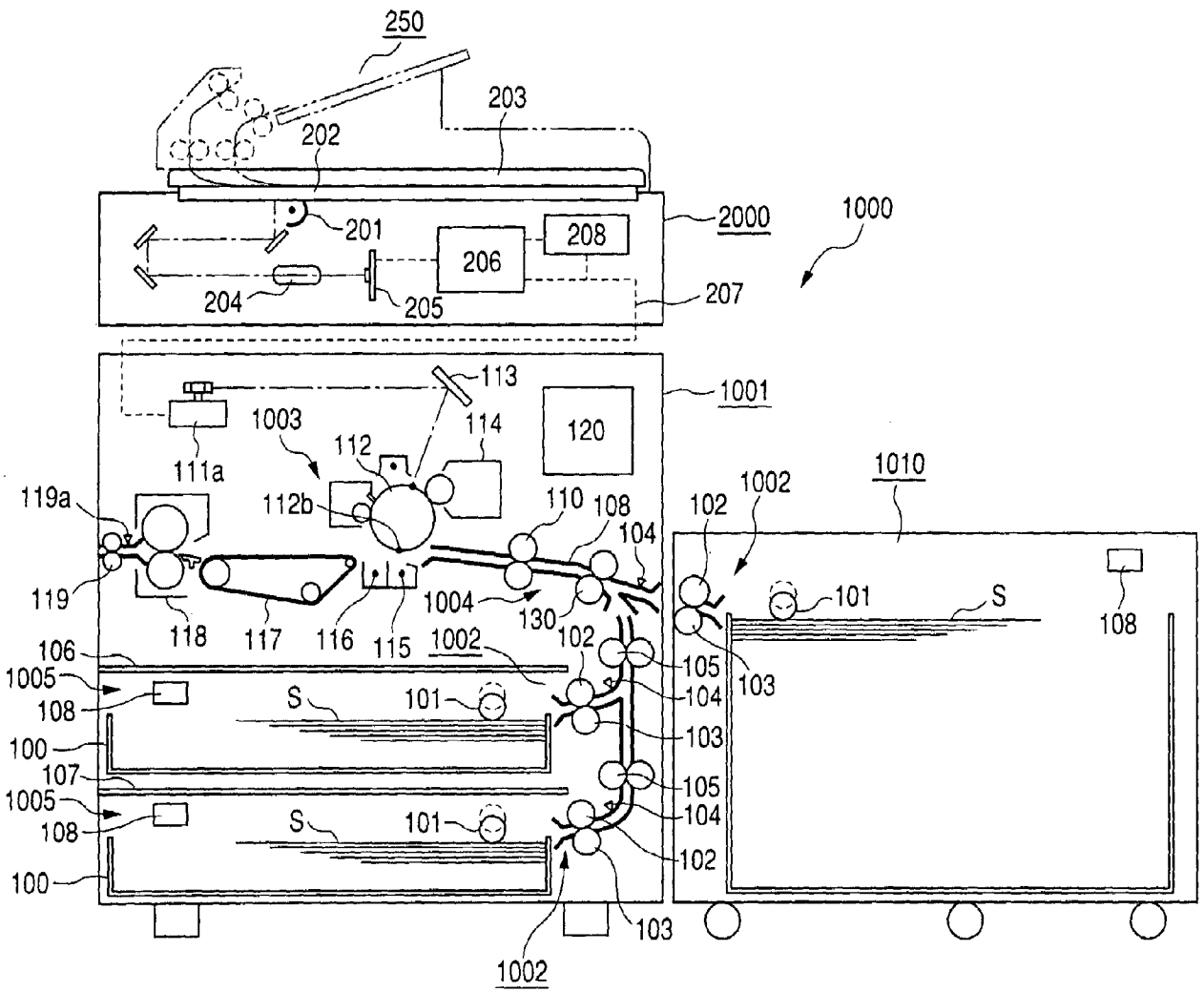
FIG. 1 is a cross-sectional view showing a printer, which is an example of an image forming apparatus having a sheet feeding apparatus according to an example of the present invention.

FIG. 1 is a cross-sectional view showing a printer, which is an example of an image forming apparatus having a sheet feeding apparatus according to an example of the present invention.

In FIG. 1, reference numeral 1000 denotes a printer, and this printer 1000 has a main body 1001 of the printer, and a scanner 2000 arranged on the upper surface of the main body 1001 of the printer.

Here, the scanner 2000 for reading an original includes: a scanning optical system light source 201; platen glass 202; an original pressure plate 203 for opening and closing; a lens 204; a light receiving element (photoelectric conversion)

205; an image processing portion 206; a memory portion 208 for storing an image processing signal processed at the image processing portion 206, and the like.

Thus, when reading the original, the original is read by irradiating light on the original (not shown) placed on the platen glass 202 by the scanning optical system light source 201. Thus, after the original image thus read is processed by the image processing portion 206, it is converted into an electrically-encoded electric signal 207 to be transmitted to a laser scanner 111*a*, which is image forming means. In this respect, it is also possible to cause the image information which has been processed by the image processing portion 206 and been encoded to be stored in the memory portion 208 once, and to transmit it to the laser scanner 111*a* as the need arises by means of a signal from a controller 120 to be described later.

The main body 1001 of the printer includes: a sheet feeding apparatus 1002 for feeding a sheet S; a sheet conveying apparatus 1004 for conveying a sheet S fed by the sheet feeding apparatus 1002 to an image forming portion 1003; a controller 120, which is control means for controlling the printer 1000, and the like.

In this case, the sheet feeding apparatus 1002 includes: a cassette 100; the pickup roller 101; and a separation portion consisting of a feed roller 102 and a retard roller 103, and the sheets S within the cassette 100 are adapted to be separated and fed one sheet at a time by an operation of the pickup roller 101 which ascends and descends/rotates at predetermined timing and the separation portion. Also, in the neighborhood of the feed roller 102 and the retard roller 103 on the downstream side in the sheet conveying direction, there is provided a sheet feeding sensor 104, and the structure is arranged such that passage of the sheet S can be detected by this sheet feeding sensor 104.

Also, in the lower part of the main body 1001 of the printer, there is provided a cassette storage 1005 in which a cassette 100 is stored, and this cassette storage 1005 is partitioned by partition plates 106, 107, and is hermetically sealed with a predetermined degree of sealing. In this respect, in the cassette 100, there are arranged temperature and relative humidity sensors 108 respectively, which are temperature and humidity detection means for detecting the temperature and humidity in the neighborhood of the cassette within the storage, and the temperature and humidity in each cassette storage 1005 are adapted to be able to be detected independently respectively.

In this respect, reference numeral 1010 denotes a detachably mountable paper deck having large capacity, available as an option, and this paper deck 1010 is provided with a sheet feeding apparatus 1002 having the same structure as the main body 1001 of the printer and a lifter base (not shown) capable of ascending and descending. Also, this paper deck 1010 is hermetically sealed with a predetermined degree of sealing, and is provided with the temperature and humidity sensors 108 for detecting temperature and humidity within the deck portion.

The sheet conveying apparatus 1004 includes a conveying roller pair 105 and a registration roller portion having a registration pre-roller pair 130 and a registration roller pair 110, and the sheet S fed from the sheet feeding apparatus 1002 is adapted to be guided to the registration roller pair 110 by the conveying roller pair 105 after passing through a sheet conveying path 108 to be constituted by a guide plate. Further, the sheet S is thereafter adapted to be conveyed to the image forming portion 1003 by the registration roller pair 110.

The image forming portion 1003 includes: a photosensitive drum 112; the laser scanner 111*a*; a developing device 114; a transfer charger 115; a separation charger 116 and the like, and on forming an image, laser light from the laser scanner 111*a* is folded back by a mirror 113, and is irradiated on an exposure position 112*a* on the photosensitive drum which is rotating in the clockwise direction, whereby a latent image is formed on the photosensitive drum, and the latent image further formed on the photosensitive drum by performing as described above is adapted to be visualized as a toner image thereafter by the developing device 114.

In this respect, the toner image on this photosensitive drum is thereafter transferred on the sheet S by the transfer charger 115 in a transfer portion 112*b*. Further, the sheet S on which the toner image has been transferred as described above is, after electrostatically separated from the photosensitive drum 112 by the separation charger 116, conveyed to a fixing apparatus 118 by means of a conveying belt 117 for fixing the toner image, and thereafter, is discharged by a discharge roller 119. Also, in a conveying route between the fixing apparatus 118 and the discharge roller 119, there is provided a sheet discharge sensor 119*a*, and the structure is arranged such that passage of the sheet S to be discharged can be detected by this sheet discharge sensor 119*a*.

In this respect, in the present example, although the main body 1001 of the printer is separate from the scanner 2000, the main body 1001 of the printer may be also integral with the scanner 2000. Also, whether the main body 1001 of the printer is separate from or integral with the scanner 2000, if a processing signal of the scanner 2000 is inputted into the laser scanner 111*a*, it will function as a copying machine, and if a transmission signal of FAX is inputted, it will function as a facsimile. Further, if an output signal of a personal computer is inputted, it will function as a printer.

If a processing signal of the image processing portion 206 of the scanner 2000 is transmitted to another FAX conversely, it will function as FAX. Also, if in the scanner 2000, such an original automatic feeding apparatus 250 as indicated by a two-dot chain line is mounted in place of the pressure plate 203, the original will be also able to be automatically read.

Figure 2:
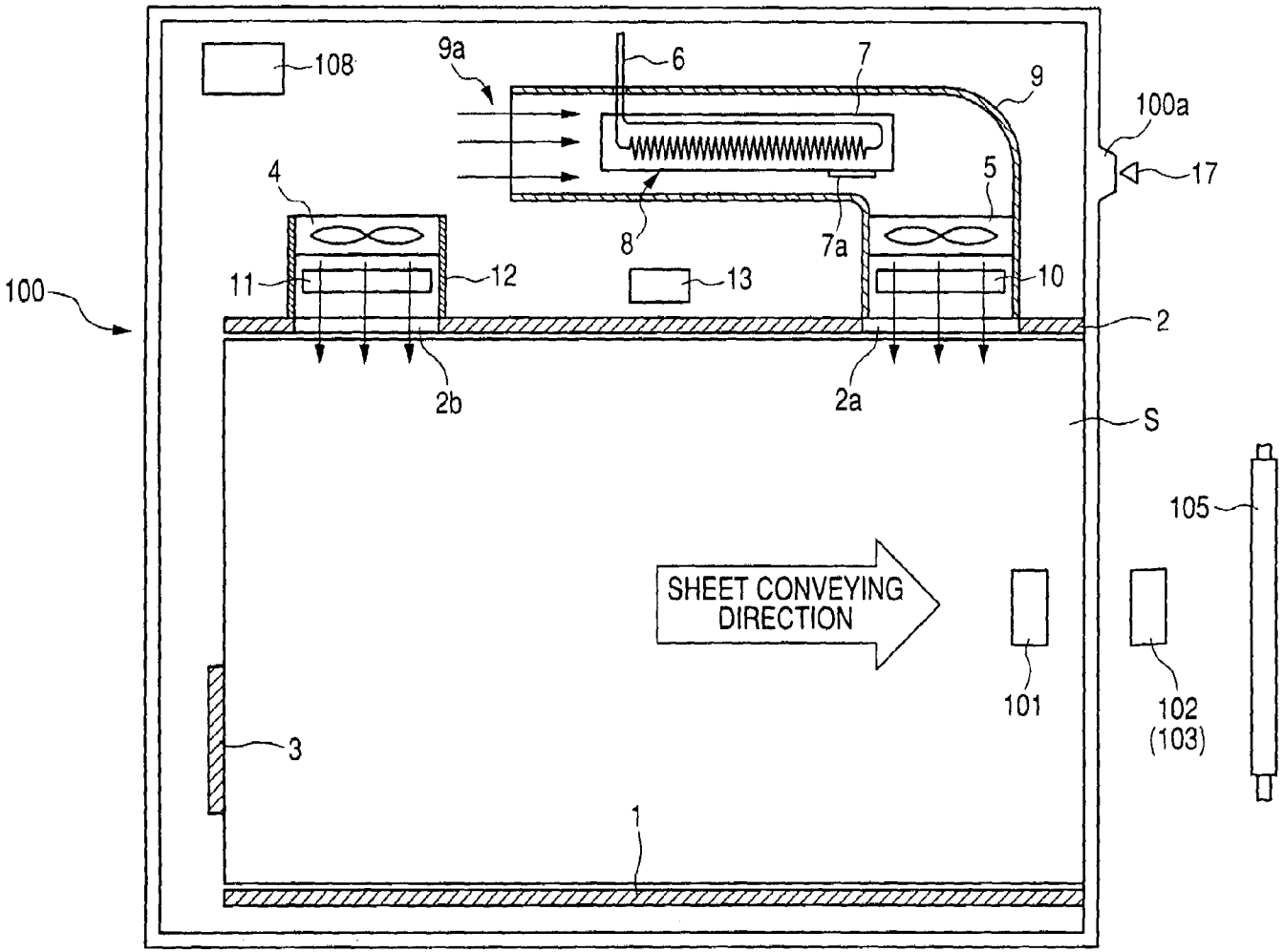
FIG. 2 is a plan view showing structure of the above-described sheet feeding apparatus.
Figure 3:
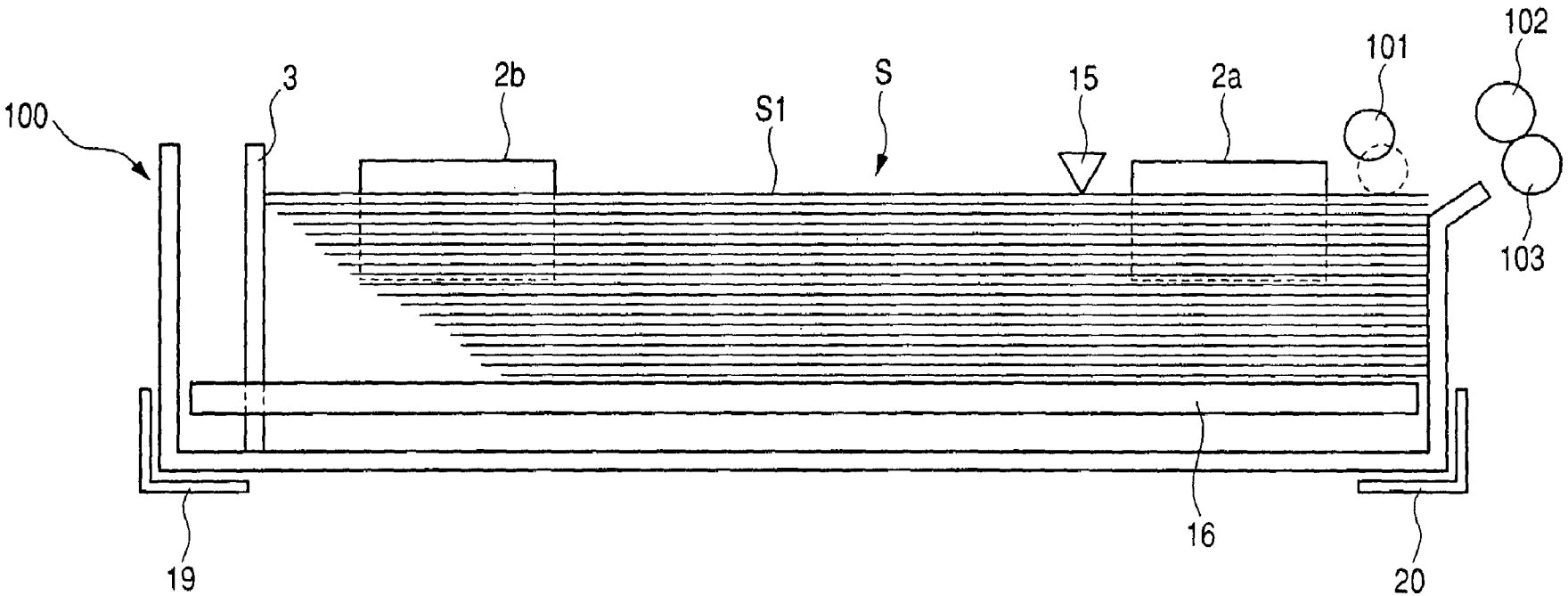
FIG. 3 is a side cross-sectional view showing the above-described sheet feeding apparatus.

FIG. 2 is a plan view showing structure of the sheet feeding apparatus 1002, and FIG. 3 is a side cross-sectional view showing the sheet feeding apparatus. In this respect, in the present example, the cassette 100 is attached to or detached from the cassette storage 1005 in a widthwise direction perpendicular to the sheet conveying direction.

In FIG. 2, reference numeral 1, 2 denotes a side regulation plate, which is a regulation member for regulating a position in a widthwise direction of sheets S stacked and housed within the cassette 100, and these side regulation plates 1, 2 are constructed to be able to move in a widthwise direction in accordance with a size of the sheets S. Also, reference numeral 3 denotes a rear end regulation plate for regulating a rear end position of the sheets S in the sheet conveying direction, and this rear end regulation plate 3 is constructed to be able to move in the sheet conveying direction in accordance with the size of the sheets S.

In this respect, the cassette 100 is adapted to be able to be drawn out along rails 19, 20 shown in FIG. 3, and when the user sets the sheets S, the cassette 100 can be drawn out on this side from the main body 1001 of the printer. Also, the cassette 100 is provided with a protruded portion 100*a* as shown in FIG. 2, and when the cassette 100 is housed within the cassette storage 1005, this protruded portion 100*a* is adapted to be detected by a cassette attachment and detachment detection sensor 17 provided in the cassette storage 1005.

Thus, a detection signal from this cassette attachment and detachment detection sensor 17 is transmitted to a controller 120, and the controller 120 is adapted to be able to detect, on the basis of the detection signal from this cassette attachment and detachment detection sensor 17, whether the cassette 100 has been mounted in the cassette storage 1005 or has been drawn out.

Figure 4:
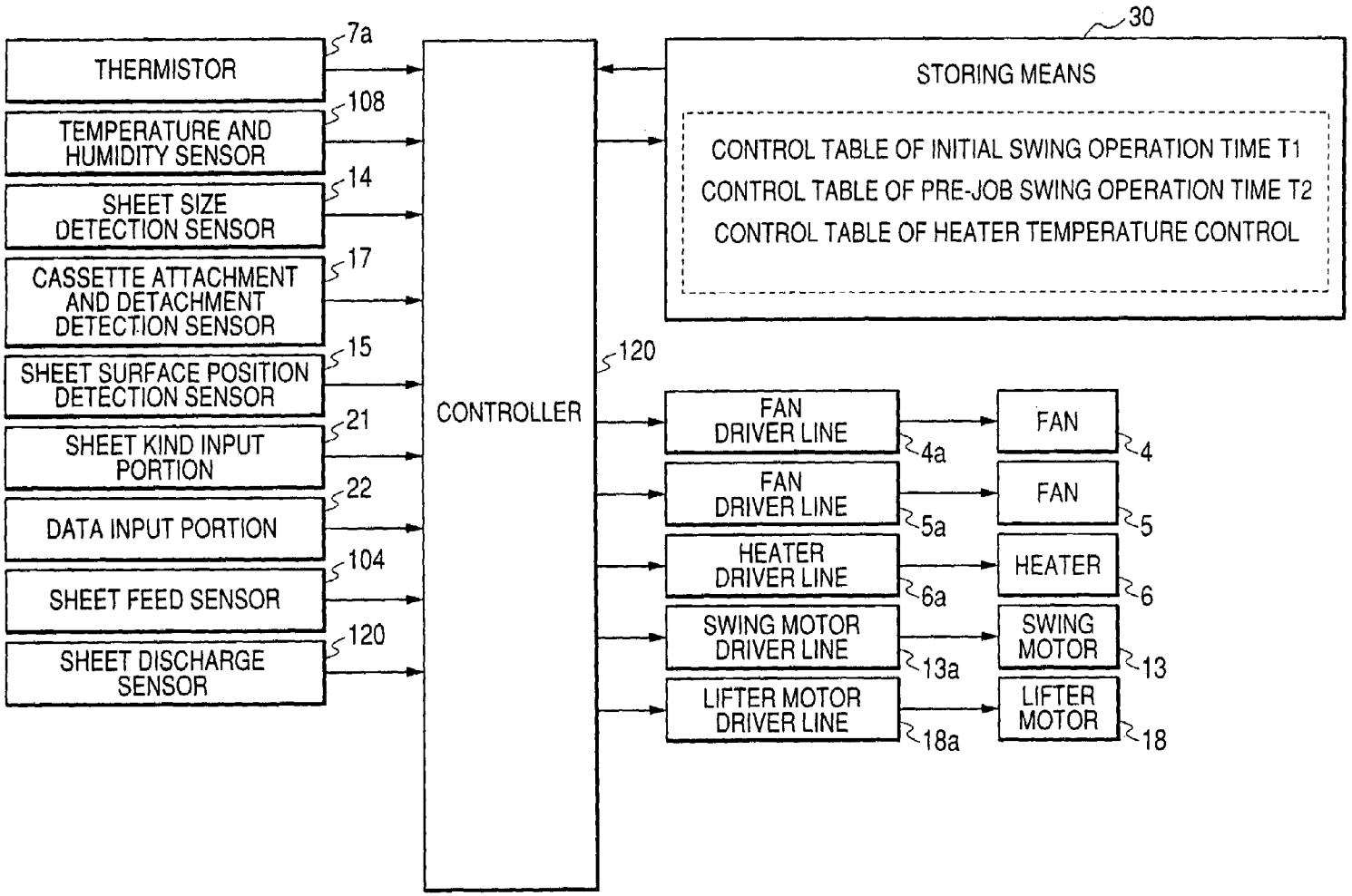
FIG. 4 is a block diagram showing the above-described printer.

Also, within the cassette 100, there is provided a lifter base 16, which is sheet stacking means capable of ascending and descending for stacking the sheets S as shown in FIG. 3, and this lifter base 16 is adapted to ascend or descend depending upon attachment or detachment of the cassette 100 by a lifter motor 18 shown in FIG. 4.

For example, when the user houses the cassette 100 in which the sheets S have been set and detects it on the basis of a signal from the cassette attachment and detachment detection sensor 17, the controller 120 is adapted to drive the lifter motor 18 for raising the lifter base 16. Also, when in order to set the sheets, the user draws out the cassette 100 to detect it on the basis of a signal from the cassette attachment and detachment detection sensor 17, the lifter motor 18 is adapted to operate so as to lower the lifter base 16 to a lower limit position.

In this respect, in the upper part of the cassette storage 1005, there is provided a sheet surface position detection sensor 15 for detecting whether or not the sheet surface position of a sheet at the uppermost position stacked on the lifter base 16 is at an appropriate height for feeding, that is, that it has reached a position whereat the sheet can be fed.

Thus, when the lifter base 16 rises, the lifter motor 18 rotates before the sheet surface position detection sensor 15, which is this sheet position detection means, detects the sheet surface position of the sheet S1 at the uppermost position. When the sheet surface position detection sensor 15 detects the sheet S1 at the uppermost position, however, the controller 120 is adapted to stop the lifter motor 18 on the basis of the detection signal from this sheet surface position detection sensor 15. Thereby, the appropriate height of sheet surface can be maintained.

In this respect, when with the feeding operation, the sheets S are fed from the higher one in order, the height of sheet surface gradually lowers and the sheet surface position detection sensor 15 becomes OFF, the controller 120 is adapted to drive the lifter motor 18 again so as to raise the lifter base 16. Thereby, the height of sheet surface can be controlled within a constant range always.

Although in the case of coated sheets, an attraction phenomenon occurs under a high humidity environment as described above, the description will be made of the elucidation of the attraction mechanism conducted by the present inventor.

Figure 5:
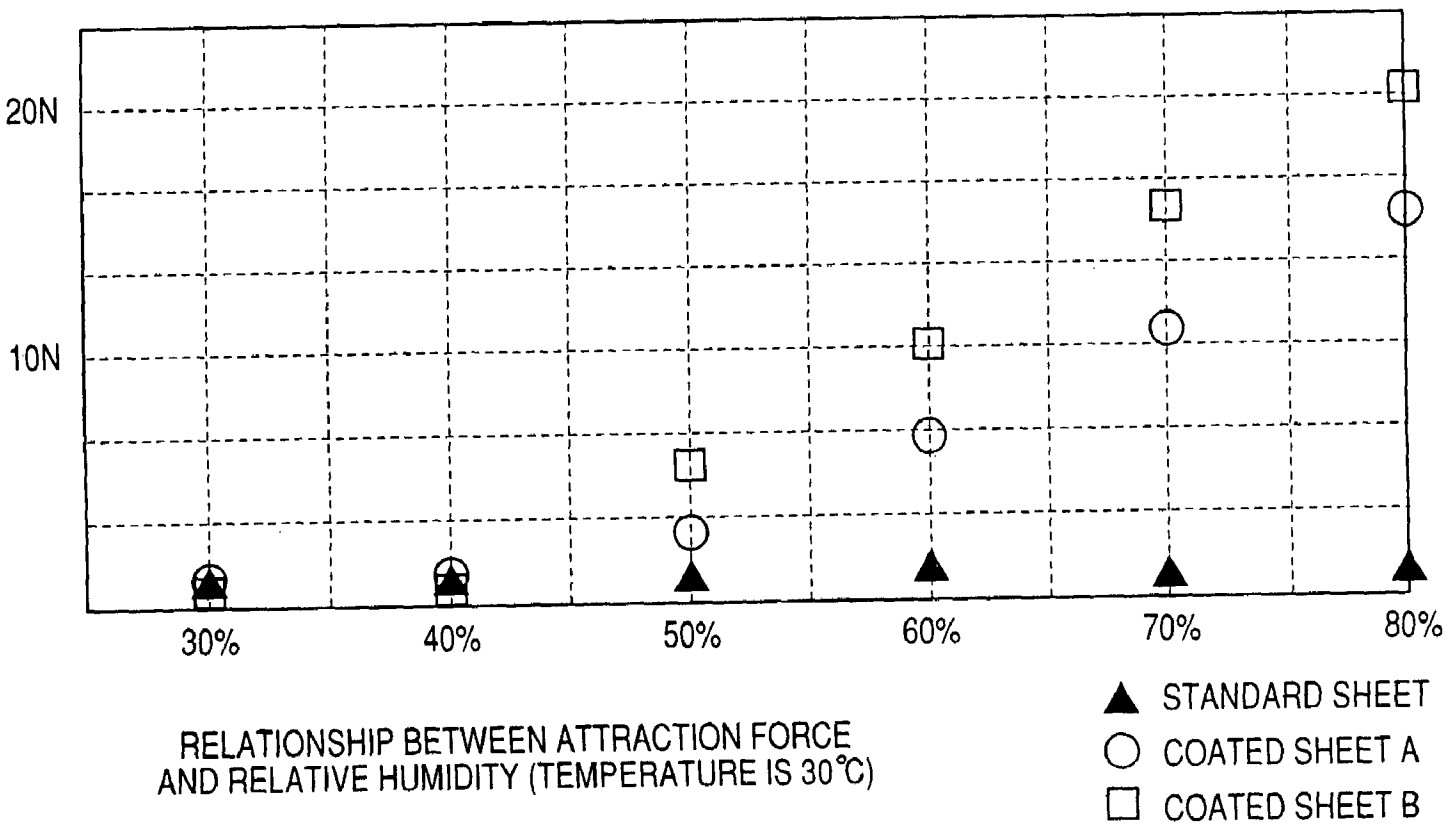
FIG. 5 is a graphic chart showing relationship between an attraction force and relative humidity.

FIG. 5 shows results of an attraction force measurement experiment made by the present inventor in advance on elucidating the attraction mechanism. In this attraction force measurement experiment, attraction forces of two kinds of coated sheets (coated sheets A and B) and a standard sheet have been measured with the environment varied. In this respect, in FIG. 5, relative humidity during the experiment is indicated on the abscissa and the attraction force, on the ordinate, and the temperature is fixed at 30° C. for measurement.

As will be apparent from the results shown in FIG. 5, the attraction force of the coated sheets A and B has very high temperature dependence much unlike the standard sheets, and in an environment at relative humidity of 40% or less, the coated sheets hardly generate any attraction force as in the case of the standard sheets. However, it can be seen that when the relative humidity exceeds 40%, the attraction force linearly increases. Also, although similar measurements have been made at temperatures of 20° C. and 40° C., the same results have been obtained. From the foregoing, it has turned out that the attraction force of the coated sheets strongly depends upon the relative humidity rather than absolute water content in the air.

The attraction mechanism of the coated sheets could be elucidated by various experiments by the present inventor as below.

Figure 6A:
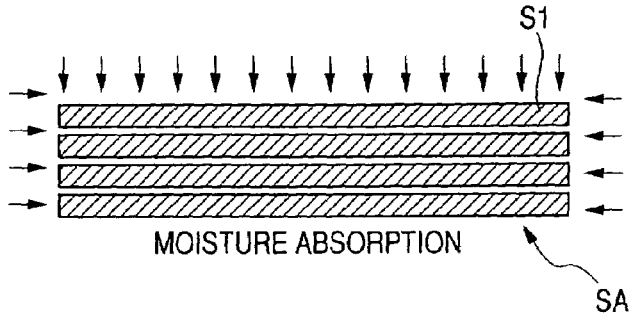
FIGS. 6A, 6B, 6C and 6D are views explaining an attraction mechanism of coated sheet.
Figure 6B:
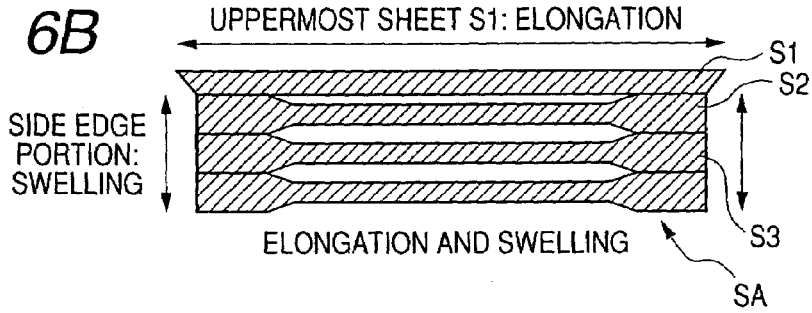

When a sheet stack SA of the coated sheets is exposed under a high humidity environment as shown in FIG. 6A, only the surface of the uppermost sheet S1 of the sheet stack SA and the side edge portion of the sheet stack SA absorb moisture. When moisture is absorbed as described above, the surface of the uppermost sheet S1 elongates and the side edge portion of the sheet stack SA swells as shown in FIG. 6B.

Figure 6C:
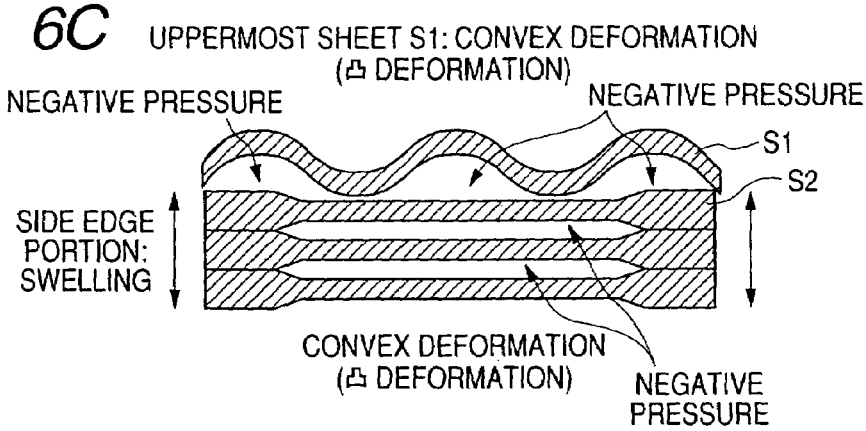

In this case, in the uppermost sheet S1, since the back surface hardly elongates though the surface elongates, a convex deformation phenomenon occurs on the uppermost sheet S1 as shown in FIG. 6C. At this time, since the coated sheet has high evenness and low gas permeability, air hardly flows into between the sheets. For this reason, when the convex deformation phenomenon occurs on the uppermost sheet S1, the volume between the uppermost sheet S1 and the next uppermost sheet S2 expands to cause negative pressure, and there occurs a phenomenon (hereinafter, referred to as uppermost sheet moisture absorption attraction) in which the next uppermost sheet S2 is attracted into the uppermost sheet S1.

Also, when in any sheet stack SA other than the uppermost sheet, the side edge portion absorbs moisture, the side edge portion swells, but a central portion of the sheet stack SA does not swell even if the side edge portion swells as described above. Therefore, the volume expands in a widthwise direction of the sheet, and accordingly there occurs a phenomenon (hereinafter, referred to as side edge portion moisture absorption attraction) in which negative pressure develops between the sheets for attracting.

Figure 6D:
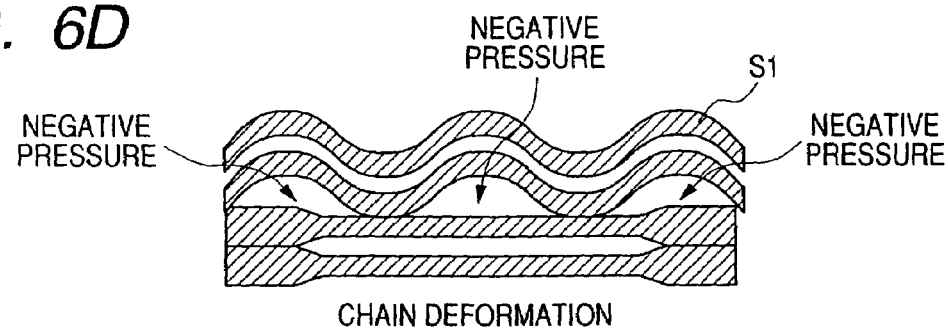

Further, when convex deformation also occurs on the second uppermost coated sheet S2 under the influence of the convex deformation of the uppermost sheet S1 as shown in FIG. 6D, there may occur a phenomenon (hereinafter, referred to as chain deformation attraction) in which negative pressure develops between the second coated sheet S2 and the third coated sheet S3 for attracting. In this respect, this chain deformation attraction may similarly occur over the third sheet and downward several tens of sheets.

As described above, as a mechanism of coated sheet attraction under high humidity, there exist three types of attraction phenomena: uppermost sheet moisture absorption and attraction, side edge portion moisture absorption and attraction, and chain deformation attraction. In this case, since the cause of these three types of attraction phenomena is that the coated sheet absorbs moisture to swell, or elongates to cause negative pressure, if air is caused to flow into between the coated sheets for nullifying the negative pressure, the attraction phenomenon will be able to be eliminated. Further, by heating air for flowing in to high temperature, the coated sheets which have absorbed moisture can be dehumidified and dried for restricting the swelling, whereby it is possible to restrict the phenomenon in which the coated sheets themselves will attract each other again.

In the present example, so as to flow air into between the coated sheets as described above, of the side regulation plates 1, 2, on the side regulation plate 2 on the back side in a widthwise direction, a plurality (at two places, in the present example) of air duct ports 2*a*, 2*b* are provided at a predetermined interval in the sheet conveying direction as shown in FIGS. 2 and 3, and are formed at a height position for facing the side of the sheets S located at least at a position whereat they can be fed. These air duct ports 2*a*, 2*b* are provided with ducts 9, 12 in which there are installed therein fans 4, 5 which are blowing means, and air is blown on the sheets S through the air duct port 2*a*, 2*b* by the fans 4, 5.

In this respect, between the fan 4, 5 and the air duct port 2*a*, 2*b*, there is provided a shutter 10, 11 so as to be able to ascend or descend, and this shutter 10, 11 is adapted to be able to ascend or descend by a swing motor 13 and an elevator mechanism (not shown). When blowing air onto the sheets S, this shutter 10, 11 is caused to gradually move up or down for swinging air to be blown up or down, whereby the air is blown into between the sheets in order and the sheets raveling effect can be enhanced.

In this respect, these fans 4, 5 and the swing motor 13 are adapted to be driven independently respectively on the basis of a signal from a controller 120 to be inputted via fan driver circuits 4*a*, 5*a* and a swing motor driver circuit 13*a* which are shown in FIG. 4.

Further, the structure is arranged such that as shown in FIG. 2, in the neighborhood of an intake port 9*a* of a duct 9 provided at the air-blow port 2*a* on the pickup roller side, there is provided air heating means 8, which is heating means consisting of a heater 6 and a heat sink 7, and that by means of the air heating means 8 provided on the upstream side of this fan 5 in the air blowing-off direction, air inhaled from the intake port 9*a* in a direction indicated by an arrow can be heated before blown off, and be blown off through the air duct port 2*a*.

In this respect, to the heat sink 7, there is installed a thermistor 7*a* for detecting temperature on the surface of the heat sink, and a detection-signal from this thermistor 7*a* is adapted to be transmitted to the controller 120 as shown in FIG. 4. Thus, the controller 120 ON/OFF-controls a heater 6 of the air heating means 8 via the driver circuit 6*a* in response to the detection signal from this thermistor 7*a*, whereby temperature of warm air from the air duct port 2*a* is adapted to be able to be controlled.

As shown in FIG. 2, the fans 4, 5, the ducts 9, 12, the air heating means 8, the shutters 10, 11 and the like are all integrally installed to the side regulation plate 2 on the back side in the widthwise direction. Thereby, even if the sheet S is changed from the size shown in FIG. 2 to the sheet $S_2$ of a smaller size shown in FIG. 7, the positional relationship with the end portion of the sheet $S_2$ can be always maintained because the fan 5 and the like also move integrally together with the side regulation plate 2 on the back side in the widthwise direction accordingly.

Figure 7:
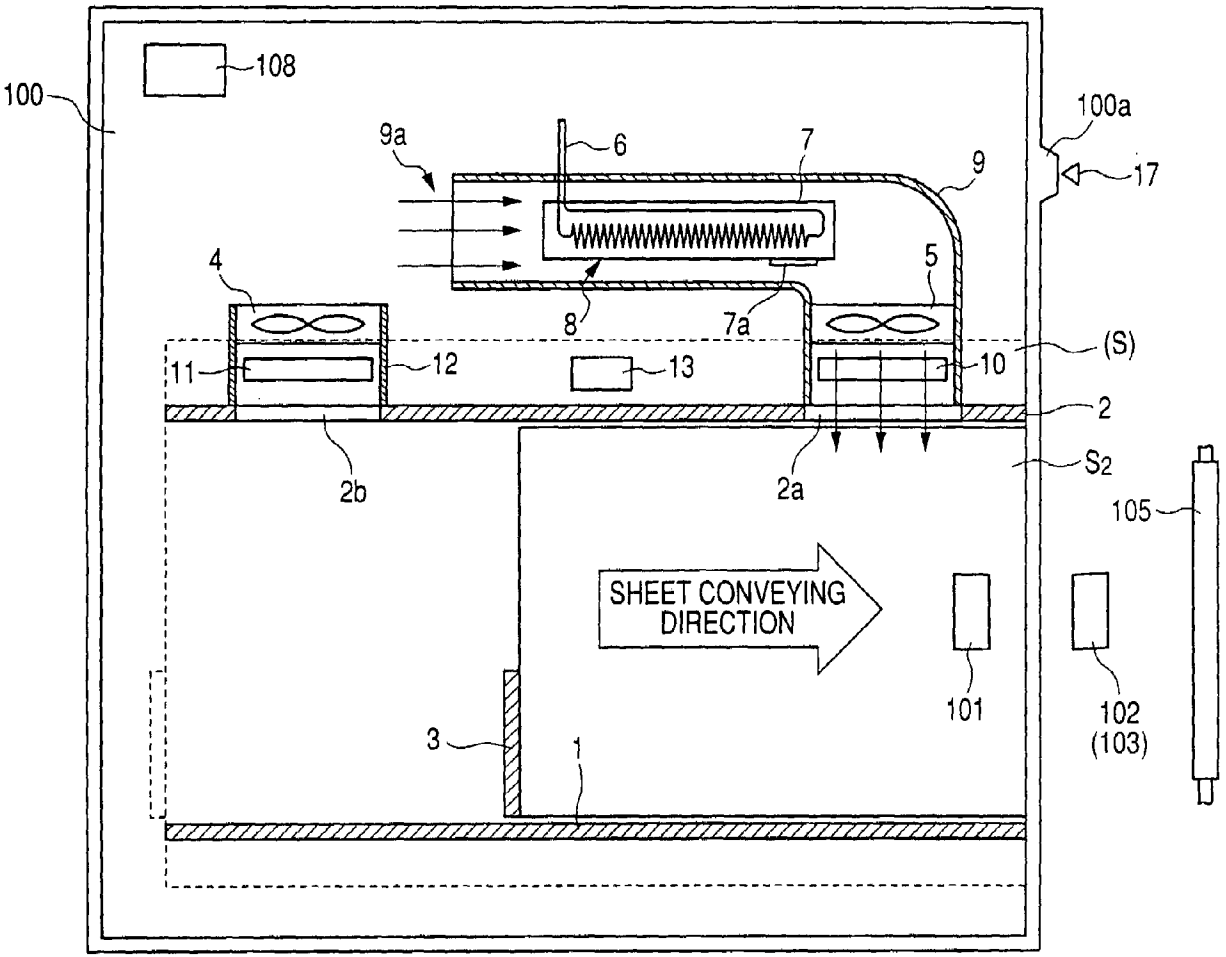
FIG. 7 is a plan view showing a state when the above-described sheet feeding apparatus has housed small-sized sheets.

In this respect, when like the sheet $S_2$ of a smaller size shown in FIG. 7, the position of the rear end of the sheet $S_2$ does not reach the air duct port 2*b* on the downstream in the sheet conveying direction, blowing by the fan 4 is wasted even if the fan 4 is driven.

For this reason, when the controller 120 is provided in the cassette 100 and the sheet S housed within the cassette 100 is judged to be a sheet of a small size on the basis of a sheet size information signal from a sheet size detection sensor 14 shown in FIG. 4 for detecting the sheet size in response to, for example, positions of the side regulation plate 1, 2 and the rear end regulation plate 3, driving of the fan 4 is adapted to be stopped independently.

Thus, air is caused to flow into between the sheets for nullifying the negative pressure as described above, and the coated sheets which have absorbed moisture by heating the air for flowing in to high temperature are dehumidified and dried, whereby it is possible to restrict the swelling and to restrict the phenomenon in which the coated sheets themselves will attract each other.

On the other hand, the present inventor has discovered by experiment that as a characteristic of the coated sheet, the attraction force reaches the uppermost one immediately after the coated sheet is opened from its wrapping paper.

Figure 8:
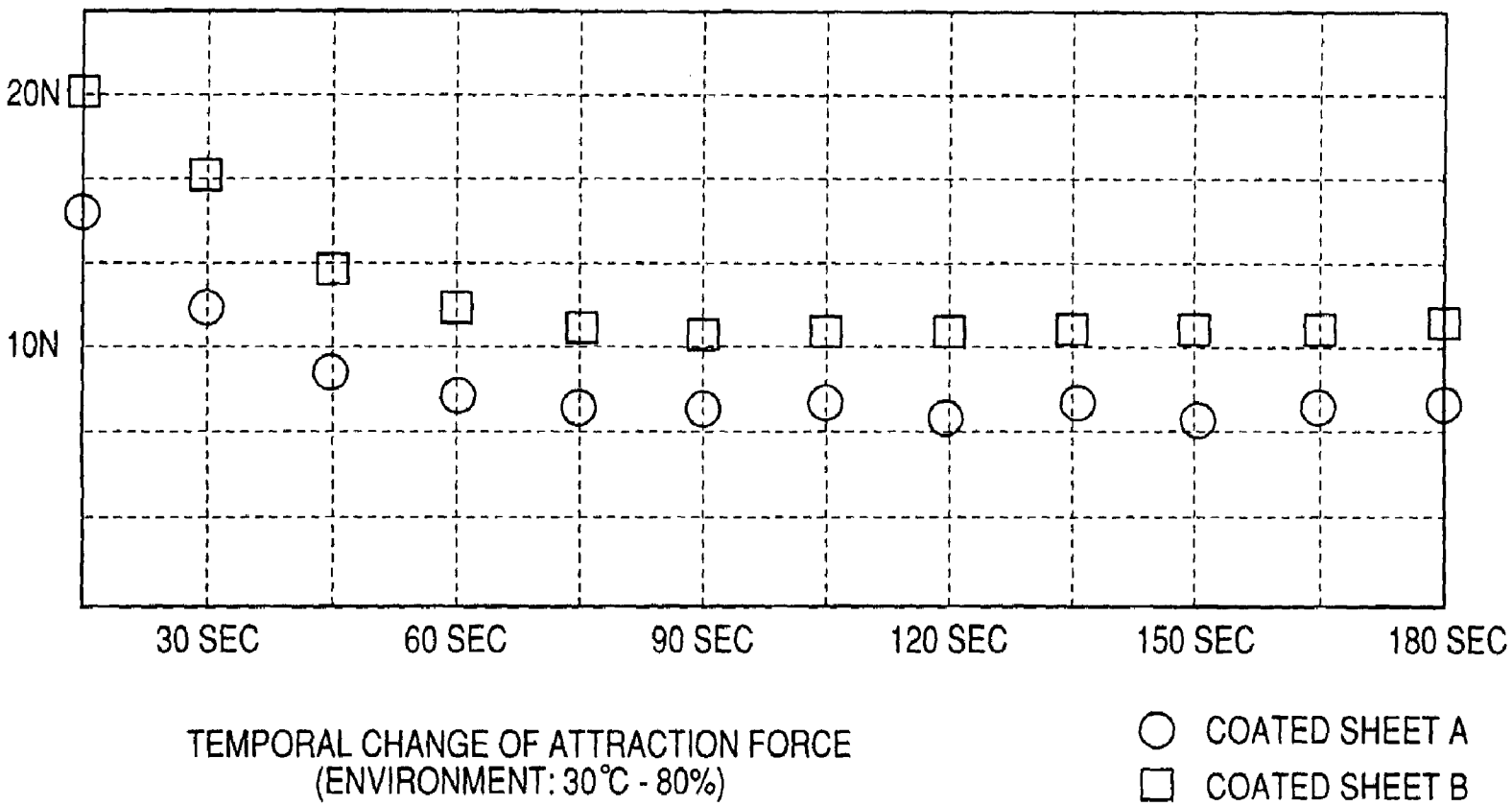
FIG. 8 is a graphic chart showing temporal change of attraction force since immediately after opened.

FIG. 8 is a view showing data obtained by measuring temporal change of attraction force of the coated sheet since during opening. In this respect, in FIG. 8, the attraction force is indicated on the ordinate, and time, on the abscissa. Also, the environment during this measurement is 30° C. and 80%.

As will be apparent from the measurement result shown in FIG. 8, the attraction force of the coated sheet is at the uppermost immediately after opened, and lowers gradually with the lapse of time. In other words, the attraction force of the coated sheet becomes the uppermost one immediately after the user houses the coated sheets within the cassette and the cassette 100 is housed within the cassette storage 1005. Hereinafter, this attraction phenomenon is referred to as attraction immediately after opened.

Figure 9:
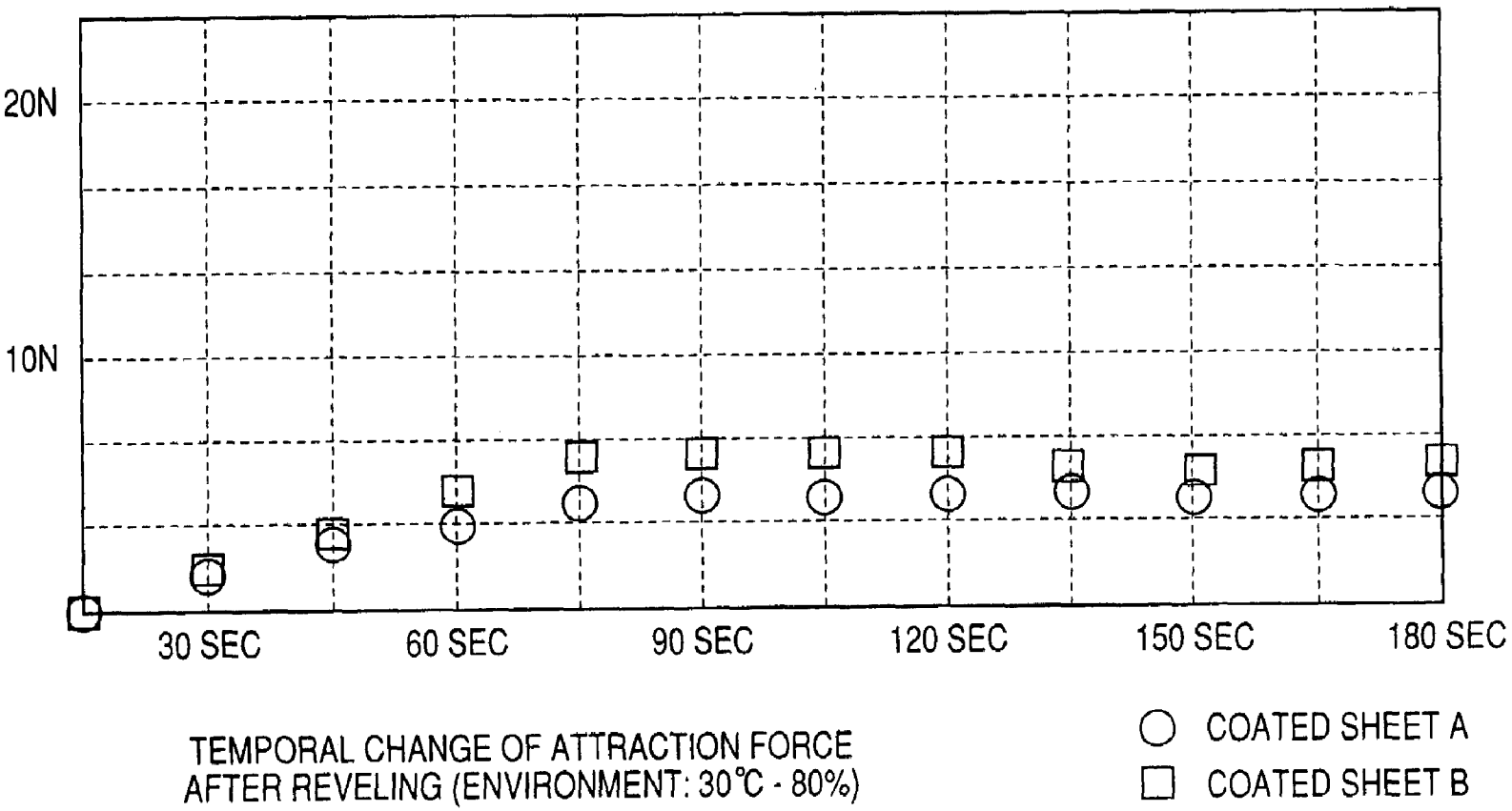
FIG. 9 is a graphic chart showing temporal change of attraction force after raveling.

Next, the present inventor has caused high-temperature air to flow into between the coated sheets attracted for raveling and measured temporal change of attraction force after the attraction force has been nullified. FIG. 9 is a view showing data obtained by measuring the temporal change of attraction force after the attraction force has been nullified. In this respect, in FIG. 9, the attraction force is indicated on the ordinate, and time, on the abscissa.

As will be apparent from the measurement result shown in FIG. 9, although the attraction force has been nullified immediately after the raveling, re-attraction gradually starts with the lapse of time, and the attraction force has considerably developed although the magnitude of the attraction force immediately after opened is not reached. Hereinafter, this attraction phenomenon is referred to as re-attraction after left standing. It has turned out that such a re-attraction after left standing and the attraction immediately after opened already described also cause double feeding or mis-feeding.

Further, in order to investigate an influence upon an image (transfer property) by partial drying of the coated sheet due to high-temperature air, the present inventor has measured partial water content of the coated sheet when warm air at 45° C. is blown for one minute under an environment of 30° C.80% and 5° C.10%. As a result, unevenness of water content could be hardly observed under the environment of 30° C.80%, and it turned out that unevenness of water content markedly occurs under the environment of 5° C.10%.

Also, when an image is transferred by the image forming portion 1003 through the use of these coated sheets, there has been no problem at all with the coated sheet at the time of 30° C.80%, but in the image at the time of 5° C.10%, it could be confirmed that the transfer becomes weaker at places partially less water content and no density appears.

In other words, it has turned out that although the coated sheet markedly attracts under high-temperature high-humidity environment, the image is not affected even if it is raveled by high-temperature air, but since attraction of the coated sheet does not occur under low-humidity low-temperature environment conversely, it is not necessary to ravel with high-temperature air blown, but when blown, an image defect occurs conversely.

Also, it has turned out that an image defect due to transfer failure under low-humidity environment is in correlation with blowing time period and blowing speed of air in addition to temperature of the air.

Thus, on the basis of these elucidation results, in the present embodiment, the structure has been arranged as below.

That is, since attraction occurs with the coated sheet immediately after opened, when the sheet surface of the coated sheet is detected by the sheet surface position detection sensor 15 after the cassette 100 is mounted in the cassette storage 1005, that is, when the coated sheet reaches a position whereat it can be fed, blowing is first performed for a predetermined time period T1 for raveling sufficiently. This operation is hereinafter referred to as initial swing operation.

Also, in order to nullify the re-attraction after left standing, blowing has been performed for a predetermined time period T2 prior to starting the feeding operation, and the raveling operation has also been performed sufficiently. This operation is hereinafter referred to as pre-job swing operation. Further, in the case of the coated sheet, since it attracts very strongly under high-humidity environment and no attraction occurs under low-humidity environment as described already, the temperature for temperature control of the heater 6 has been set in response to each environment.

At least one of the initial swing operation and the pre-job swing operation is performed prior to starting the feeding operation as described above, whereby it is possible to bring the coated sheets in a reliably raveled state during sheets feeding. In this respect, in the present invention, "prior to starting the feeding operation" includes both when sheets for performing the initial swing operation reach a position whereat they can be fed, and when in order to perform the pre-job swing operation, a job starting button as job starting signal generating means for generating a job starting signal for starting the job has been depressed by an user to be described later.

FIGS. 10 to 12 are control tables concerning optimum air blowing time (initial swing time T1, pre-job swing time T2) and temperature of air (temperature for temperature control of heater 6) formed by the present inventor by taking into consideration an influence upon transfer property under each environment in which the sheet feeding apparatus 1002 is used. In this respect, a control table of blowing time, a control table of heating temperature, a control table of heating temperature and a control table of fan blowing speed in the initial swing and the pre-job swing shown in these FIGS. 10 to 12 have been stored in the storing means 30 shown in FIG. 4.

Thus, when sheets to be set in the cassette 100 have been set to be, for example, coated sheets in the sheet kind input portion 21 in the operation portion shown in FIG. 4, at a point of time whereat the cassette 100 has been mounted in the cassette storage 1005, the initial swing has been to be performed by a predetermined time T1 in response to environmental conditions within the cassette storage 1005 or the cassette 100.

In this respect, since neither attraction immediately after opened under a high-humidity environment nor re-attraction after left standing occurs with sheets made of resin material such as OHP and art film, the initial swing or the pre-job swing may not be performed. Also, since the attraction mechanism is also application by charging, it is not necessary to heat air by the heater 6. Thereby, time for the heater 6 to complete the temperature control can be reduced.

Also, in the case of standard sheets, since they naturally do not attract, the raveling operation due to air during the feeding operation is not required. When not required as described above, the initial swing, the pre-job swing and temperature control of the heater 6 will not be performed as much as possible, whereby the user can use the printer comfortably because FCOT becomes faster.

Figure 13:
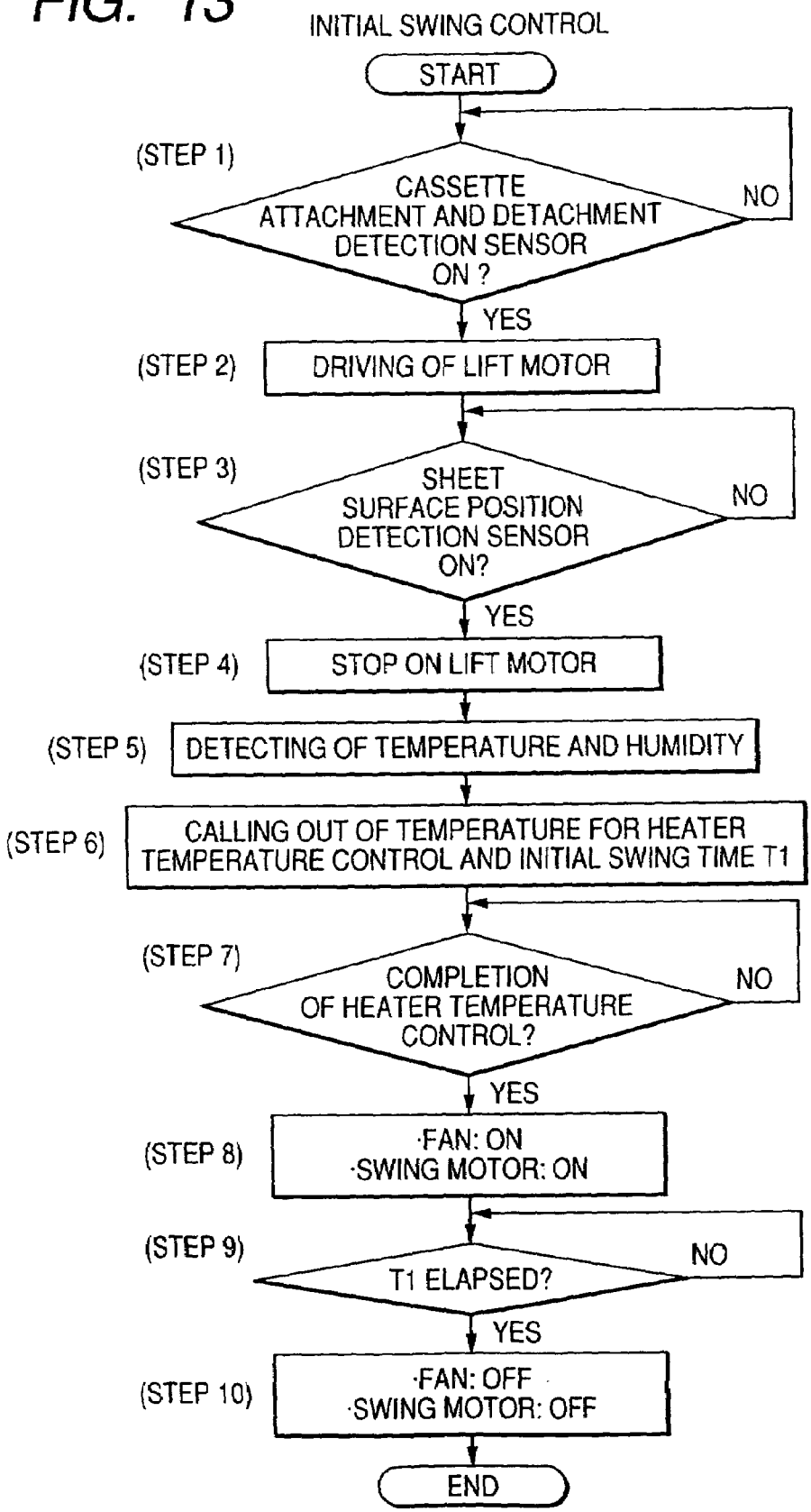
FIG. 13 is a flow chart showing an initial swing operation of the above-described sheet feeding apparatus.

Next, with reference to the flow chart shown in FIG. 13, the description will be made of the initial swing operation.

When the cassette 100 is mounted in the cassette storage 1005 and the cassette attachment and detachment detection sensor 17 which has detected it is turned ON (Y of Step 1), the controller 120 rotationally drives the lifter motor 18 in a direction to raise the lifter base 16 (Step 2). Thereafter, the position of the sheet surface gradually rises together with the lifter base 16, and when soon the sheet surface position detection sensor 15 detects the sheet surface to turn ON (Y of Step 3), the lifter motor 18 is caused to stop (Step 4).

Next, the temperature and humidity sensor 108 detects temperature and humidity within the cassette storage (cassette 100) (Step 5), and the controller 120 calls out data on temperature for heater 6 temperature control and the initial swing time T1 from the control tables shown in FIGS. 10 and 12 on the basis of these temperature and humidity detected (Step 6). Thus, the heater 6 is electrically energized via the heater driver circuit 6*a* (See FIG. 4) to perform temperature control of the heater 6.

Next, when temperature control of the heater 6 is completed (Y of Step 7), the fans 4, 5 and the swing motor 6 are turned ON (Step 8). Thereafter, when the initial swing time T1 obtained from the control table elapses (Y of Step 9), the fans 4, 5 and the swing motor 6 are turned OFF (stopped) (Step 10).

Thus, immediately after opened as described above, air heated is blown on the coated sheets, whereby it is possible to nullify the attraction between the coated sheets and to reliably ravel the coated sheets. Thereby, it is possible to provide a highly reliable sheet feeding apparatus in which jamming and double feeding do not occur. Also, as regards this initial swing time T1 and the temperature for temperature control, since an optimum table obtained by experiments so as to make the raveling ability of coated sheets and the image quality compatible is used, image deterioration such as transfer failure does not occur as a matter of course.

In this respect, when there is a possibility that the coated sheets have not been sufficiently raveled in the initial swing operation, any job starting may not be accepted before the initial swing operation is completed, or after the job starting is accepted once, the job may be started after the completion of the initial swing operation.

Figure 14:
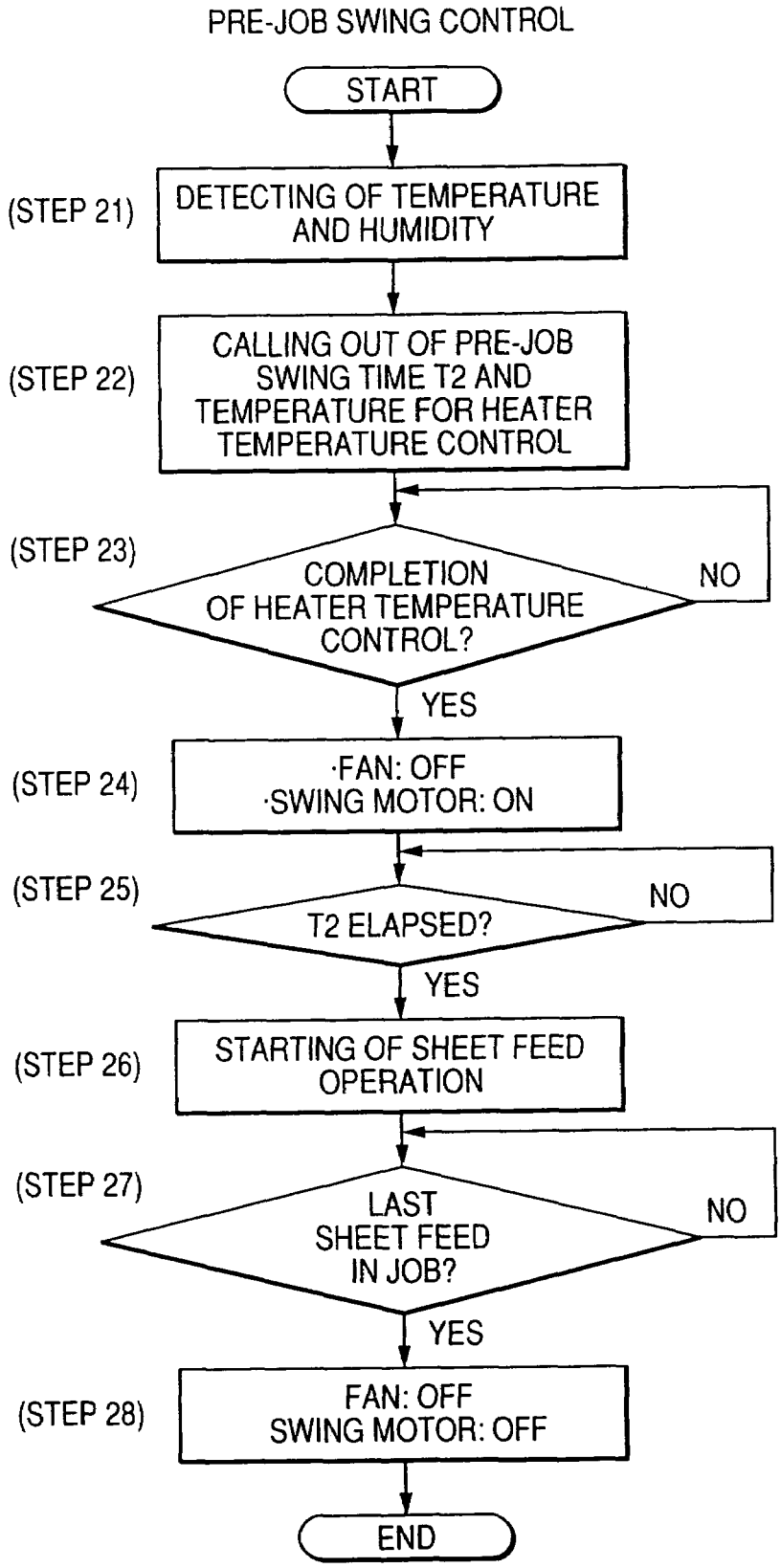
FIG. 14 is a flow chart showing a pre-job swing operation of the above-described sheet feeding apparatus.
Figure 15:
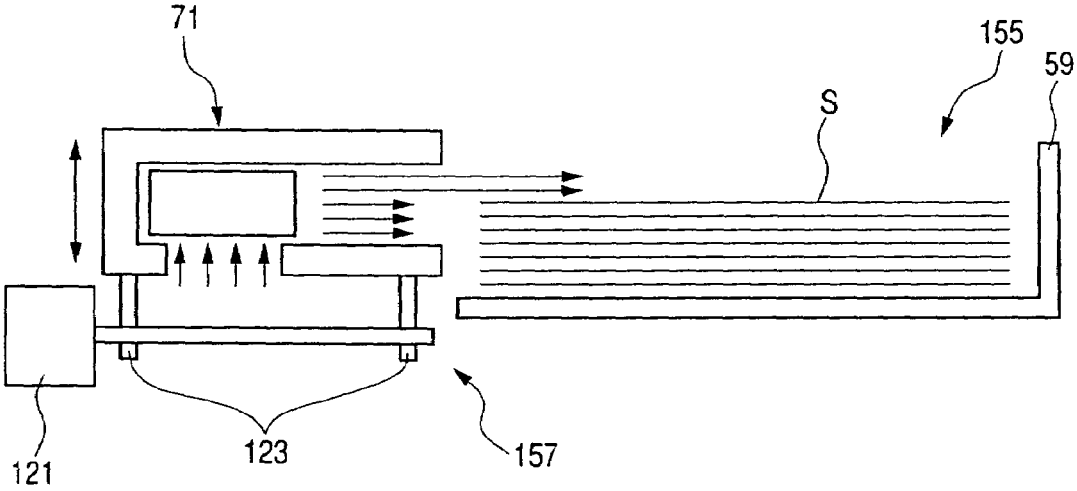
FIG. 15 is a view for explaining conventional structure of the sheet feeding apparatus.

Next, with reference to the flow chart shown in FIG. 14, the description will be made of the pre-job swing operation to be performed prior to starting the feeding operation in order to nullify the re-attraction after left standing.

When a job starting button as job starting signal generating means for generating a job starting signal for starting the job is depressed by the user, the temperature and humidity sensor 108 first detects temperature and humidity within the cassette storage (cassette 100) (Step 21), and the controller 120 calls out data of the pre-job swing time T2 and the temperature for temperature control of the heater 6 temperature control from the control table shown in FIGS. 11 and 12 on the basis of these temperature and humidity detected (Step 22).

Thus, the heater 6 is electrically energized on the basis of the data of the temperature for temperature control called out to perform temperature control of the heater 6, and when the temperature control of the heater 6 is completed (Y of Step 23), the fans 4, 5 and the swing motor 6 are turned ON (Step 24). Thereafter, when the pre-job swing time T2 obtained from the control table elapses (Y of Step 25), the feeding operation is started (Step 26). When the predetermined job is completed, that is, when the last sheet of the job is fed (Y of Step 27), the fans 4, 5 and the swing motor 6 are turned OFF (stopped) (Step 28).

Thus, before starting the feeding operation after left standing as described above, air heated is blown on the coated sheets, whereby it is possible to nullify the re-attraction for reliably raveling the coated sheets.

When the sheets reach a position whereat they can be fed and before the sheet feeding operation is started, the air is blown from the side of the sheets S during predetermined time T1, T2, whereby it is possible to reliably separate and feed the various sheets such as coated sheets, OHP, art film and ultra thick paper without causing image defects such as transfer failure.

Also, the temperature for temperature control of the heater 6 is set on the basis of a signal from the temperature and humidity sensor 108 provided in the neighborhood of the cassette 100, whereby it is possible to provide a good-quality image free from image defects such as transfer failure together with achieving good feeding performance.

In this respect, in the foregoing description, the description has been made of a case where air is blown from the side of the sheets by performing both the initial swing and the pre-job swing when mounting a cassette and before the feeding operation is started. However, the present invention is not limited thereto, but at least either of them may be performed. For example, when feeding sheets immediately after the initial swing, the pre-job swing may be omitted, and when the feeding operation is continuously performed, the initial swing may be omitted.

In this respect, in the present example, the detailed description has been made of the control when the coated sheets are used. However, the present invention is not limited thereto, but even in any other OHP, art film, ultra-thick paper and other standard sheets than the coated sheets which are different in characteristic due to environment, control table may be prepared respectively.

In the case of, for example, the OHP film or art film as described above, since the attraction due to charging occurs under a low-humidity environment, blowing can be performed at high wind velocity under the low-humidity environment, and blowing can be performed at low wind velocity under a high-humidity environment because the attraction due to charging hardly occurs under the high-humidity environment. Also, in the case of sheets made of these resin materials, since moisture is not absorbed, it is not necessary to use warm air, but therefore, the heater can be kept OFF.

Also, in the case of the ultra-thick paper, since the conveying resistance is increased due to its dead load and the pickup failure occurs, there is no environmental dependence in this case. Therefore, blowing can be performed under all environments. Also, since no attraction due to moisture absorption occurs as in the case of the OHP and the like, it is not necessary to use warm air, but therefore, the heater can be kept OFF.

As described above, it may be possible to prepare a control table for temperature for temperature control of the heater, wind velocity, blowing time and the like which is optimum for each material, and to provide the sheet kind input portion 21 as sheet kind input means as shown in FIG. 4 in such a manner that the controller 120 selects an optimum control table of time from among a plurality of control tables of time in response to sheet kind information from this sheet kind input portion 21 for use. Also, since the attraction characteristic and transfer characteristic of the coated sheet differ with kind and grade thereof, control tables optimum for coated sheets having respective kinds and grades can be prepared. Thereby, it is possible to provide a further highly reliable sheet feeding apparatus.

Further, in order to re-write data of tables for time control, control of temperature control and the like and to add new tables, it may be also possible to provide a data input portion 22 as shown in FIG. 4 in such a manner that the user or service staffs can freely prepare each control table already described in response to respective uses via the data input portion 22 for storing it.

In this respect, in the above-described example, there has been disclosed the structure in which on the side (one end portion of the sheets in a widthwise direction) of a sheet stack stacked on the lifter base 16, there are arranged fans 4, 5 and air duct ports 2*a*, 2*b* to blow air on the side end of the sheet stack. However, the present invention is not limited thereto, but can be applied to structure in which on the front side of the sheets stacked in the feeding direction, there is provided a air duct port so as to blow air on the front-side end portion of the sheet stack.

In this respect, the initial swing operation and the pre-job swing operation already described are also performed on the sheet deck, whereby it is possible to reliably separate and feed sheets without causing any image defects such as transfer failures.

Also, in the present example, as the sheet feeding and separating means, there has been cited the retard system as an example, but it goes without saying that this may be the separating pad system or the air sheet-feeding system.

This application claims priority from Japanese Patent Application No. 2003-301029 filed on Aug. 26, 2003, which is hereby incorporated by reference herein.

What is claim is:

1. A sheet feeding apparatus for feeding sheets, comprising:

sheet stacking means for supporting sheets;

sheet feeding means for feeding sheets stacked on said sheet stacking means;

blowing means for blowing air on an end portion of a sheet sheaf stacked on said sheet stacking means;

temperature and humidity detection means for detecting temperature and humidity in the neighborhood of said sheet stacking means;

control means for controlling said blowing means to perform a blowing operation before a sheet feeding operation of said sheet feeding means is started; and a control table of blowing time in which data of blowing time period of the blowing means corresponding to the temperature and humidity has been stored;

wherein said control means calls out data of the blowing time period from said control table of blowing time on the basis of temperature and humidity information from said temperature and humidity detection means and controls said blowing means to perform the blowing operation before the sheet feeding operation during the blowing time period called from the control table.

2. The sheet feeding apparatus according to claim 1, provided with said sheet stacking means so as to be able to ascend and descend, further comprising sheet position detection means for detecting that an upper surface of a sheet sheaf supported by said sheet stacking means reaches a position whereat it can be fed by said sheet feeding means, wherein when it has been detected by said sheet position detection means that the sheet sheaf reaches a position whereat it can be fed, said control means calls out a initial blowing time period from said control table of blowing time and controls said blowing means to perform the blowing operation before the sheet feeding operation during the initial blowing time period.

3. The sheet feeding apparatus according to claim 1, further comprising:

job starting signal generating means for generating a job starting signal for starting a job, wherein when a job starting signal has been generated by said job starting signal generating means, said control means calls out a pre-job blowing time period from said control table of blowing time and controls said blowing means to perform the blowing operation before the sheet feeding operation during the pre-job blowing time period.

4. The sheet feeding apparatus according to claim 2, further comprising:

heating means for heating air to be blown from said blowing means; and a control table of heating temperature in which data of temperature of said air to be blown from said blowing means corresponding to temperature and humidity has been stored, wherein said control means calls out data of heating temperature from said control table of heating temperature on the basis of temperature and humidity information from said temperature and humidity detection means and controls a heating operation of said heating means on the basis of the data of heating temperature called from the control table of heating temperature.

5. The sheet feeding apparatus according to claim 3, further comprising:

heating means for heating air to be blown from said blowing means; and a control table of heating temperature in which data of temperature of said air to be blown from said blowing means corresponding to temperature and humidity has been stored, wherein said control means calls out data of heating temperature from said control table of heating temperature on the basis of temperature and humidity information from said temperature and humidity detection means and controls a heating operation of said heating means on the basis of the data of heating temperature from the control table of heating temperature.

6. A sheet feeding apparatus for feeding sheets, comprising:

a lifter base on which a sheet sheaf has been stacked;

a pickup roller which feeds out sheets from said lifter base;

a blow-off port arranged to oppose to an end portion of the sheet sheaf on said lifter base;

a fan which blows air on an end portion of the sheet sheaf stacked on said lifter base through said blow-off port;

a temperature and humidity sensor which detects temperature and humidity in the neighborhood of said lifter base;

a controller for controlling said fan to perform a blowing operation before a sheet feeding operation of said pickup roller is started; and a control table of blowing time in which data of blowing time period of the fan corresponding to the temperature and humidity has been stored;

wherein said controller calls out data of the blowing time period from said control table of blowing time on the basis of temperature and humidity information from said temperature and humidity sensor and controls said fan to perform the blowing operation before the sheet feeding operation during the blowing time period called from the control table.

7. The sheet feeding apparatus according to claim 6, provided with said lifter base so as to be able to ascend and descend, further comprising:

a sheet position detection sensor which detects an upper surface of the sheet sheaf reaches a position whereat it can be fed;

when it has been detected by said sheet position detection sensor that the sheet sheaf reaches the position whereat it can be fed, said controller calls out a initial blowing time period from said control table of blowing time and controls said fan to perform the blowing operation before the sheet feeding operation during the initial blowing time period.

8. The sheet feeding apparatus according to claim 6, further comprising:

job starting signal generating means for generating a job starting signal for starting a job, wherein when a job starting signal has been generated by said job starting signal generating means, said controller calls out a pre-job blowing time period from said control table of blowing time and controls said fan to perform the blowing operation before the sheet feeding operation during pre-job blowing time period.

9. The sheet feeding apparatus according to claim 7, further comprising:

heater which heats air to be blown from said fan; and a control table of heating temperature in which data of temperature of said air to be blown from said fan corresponding to temperature and humidity has been stored, wherein said control means calls out data of heating temperature from said control table of heating temperature on the basis of temperature and humidity information from said temperature and humidity sensor and controls a heating operation of said heater on the basis of the data of heating temperature called from control table of heating temperature.

10. The sheet feeding apparatus according to claim 8, further comprising:

heater which heats air to be blown from said fan; and a control table of heating temperature in which data of temperature of said air to be blown from said fan corresponding to temperature and humidity has been stored, wherein said control means calls out data of heating temperature from said control table of heating temperature on the basis of temperature and humidity information from said temperature and humidity sensor and controls a heating operation of said heater on the basis of the data of heating temperature called from control table of heating temperature.

11. An image forming apparatus comprising: an image forming portion for forming an image on a sheet; and a sheet feeding apparatus for feeding the sheet to said image forming portion according to any one of said claims 1 to 10.

* * * * *

UNITED STATES PATENT AND TRADEMARK OFFICE

CERTIFICATE OF CORRECTION

PATENT NO. : 7,140,606 B2
APPLICATION NO. : 11/357023
DATED : November 28, 2006
INVENTOR(S) : Takeshi Suga et al.

It is certified that error appears in the above-identified patent and that said Letters Patent is hereby corrected as shown below:

COLUMN 6:
Line 43, "structure" should read --a structure--.

COLUMN 10:
Line 63, "places" should read --places having--.

COLUMN 14:
Line 27, "a" should read --an--.

COLUMN 15:
Line 7, "a" should read --an--.

COLUMN 16:
Line 19, "a" should read --an--.

Signed and Sealed this

Twenty-fourth Day of April, 2007

JON W. DUDAS
*Director of the United States Patent and Trademark Office*